US005407198A

United States Patent [19]

Morrow et al.

[11] Patent Number: 5,407,198

[45] Date of Patent: * Apr. 18, 1995

[54] CONTROLLER FOR A HOCKEY PUCK PROJECTING AND GUIDING APPARATUS

[75] Inventors: Jon Morrow, Manitowoc, Wis.; Saul Boast, Peoria, Ill.; Eric P. Hansotia, Marshfield, Wis.

[73] Assignee: Jon Morrow, Appleton, Wis.

[ * ] Notice: The portion of the term of this patent subsequent to Oct. 26, 2010 has been disclaimed.

[21] Appl. No.: 139,295

[22] Filed: Oct. 19, 1993

Related U.S. Application Data

[62] Division of Ser. No. 813,351, Dec. 24, 1991, Pat. No. 5,255,917.

[51] Int. Cl.[6] ..... A63B 69/00; F41B 3/04

[52] U.S. Cl. ..... 273/129 R; 273/57.2; 124/6; 124/42

[58] Field of Search ..... 273/129 R, 129 M, 57.2, 273/26 R, 26 D; 124/4, 6, 78, 41.1, 42

[56] References Cited

U.S. PATENT DOCUMENTS 3,602,208 8/1971 Huerlimann .
3,665,910 5/1972 Boni .
3,817,235 6/1974 Blake .
3,822,688 7/1974 Mayne .
3,838,677 10/1974 Alvares .
3,876,201 4/1975 King .
3,989,245 11/1976 Augustine, Jr. et al. .
4,233,953 11/1980 Bash .
4,655,190 4/1987 Harris .
5,044,350 9/1991 Iwabuchi et al. .
5,255,917 10/1993 Morrow et al. .

*Primary Examiner*—Raleigh W. Chiu
*Attorney, Agent, or Firm*—Foley & Lardner

[57] ABSTRACT

A system for projecting a hockey puck is provided which includes a hockey puck projector and an associated control system. The hockey puck projector includes a plurality of rollers for supporting the bottom surface of a hockey puck, a wheel for engaging the top surface of the hockey puck, a motor for rotating the wheel, and a ram for moving the hockey puck between the rollers and the rotating wheel. The control system includes servos for rotating the hockey puck projector in three dimensions and a computer control for driving the servos and providing set points which determine the projectory of a projected hockey puck. A hockey puck is projected by the projector when the wheel is rotated and the hockey puck is moved into engagement by the rotating wheel which imparts motion to the hockey puck. The rotating wheel engages the hockey puck above a plurality of rollers which support the puck.

5 Claims, 7 Drawing Sheets

FIG. 4A
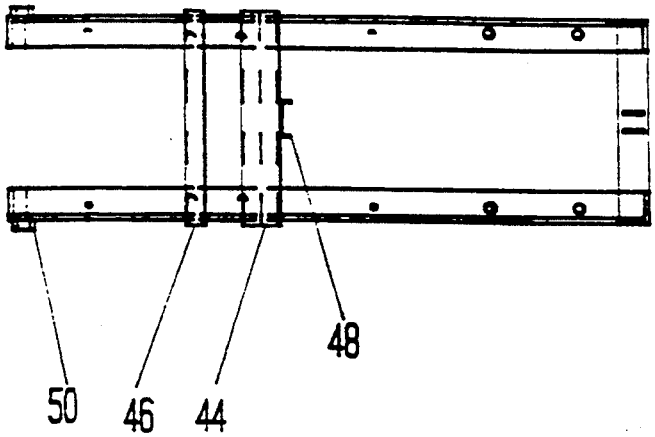
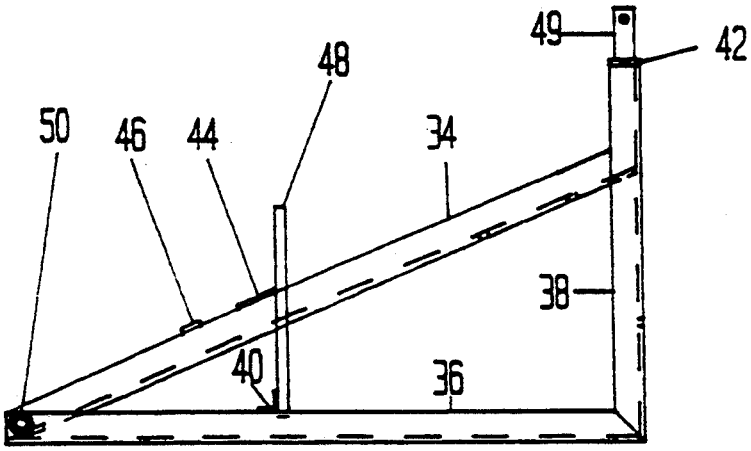
FIG. 4B

CONTROLLER FOR A HOCKEY PUCK PROJECTING AND GUIDING APPARATUS

This is a divisional of Ser. No. 07/813,351, filed on Dec. 24, 1991, U.S. Pat. No. 5,255,917.

FIELD OF THE INVENTION

This invention relates to an apparatus for projecting hockey pucks. More particularly, the present invention relates to a hockey puck projecting apparatus having the capability of controllably projecting a hockey puck toward a plurality of predetermined locations.

BACKGROUND OF THE INVENTION

In general, apparatus for projecting hockey pucks are known. Referring to U.S. Pat. No. 3,876,201 issued to Gordon Allen King on Apr. 8, 1975, the '201 patent discloses an apparatus for projecting hockey pucks. The apparatus includes a base having a bearing for rotatably mounting a sweeper coupled to a rotating means. The rotating means includes a vertical shaft having a crank at its upper end for manually rotating the shaft and the sweeper through a sweep path. When the crank is turned, the vertical shaft rotates, and the sweeper is turned through the sweep path until it strikes a puck and projects it outwardly onto and along an ice, or other playing, surface.

U.S. Pat. No. 3,838,677 issued to Edmund Alvares on Oct. 1, 1974, discloses a machine for automatically shooting and propelling a hockey puck. The machine includes a motor with an energy storing spring adjustably attached to the motor shaft. The motor rotates the spring into an energy storing position. Upon release of the spring the spring strikes a puck to propel it in a desired direction at a desired rate of speed.

U.S. Pat. No. 3,822,688 issued to David L. Mayne on Jul. 9, 1974, discloses a hockey puck shooting machine which automatically ejects a succession of hockey pucks in timed sequence as an aid in training players in blocking pucks. The machine is adapted to eject pucks at varying speeds, intervals, and with variations in directions so as to provide a random effect such as experienced by a goal keeper or other player. The machine includes a centrifugal ejector for pucks, and a multiple magazine feeding apparatus for delivering one puck at a time to the ejector, at a rate within the capacity of the ejector.

U.S. Pat. No. 3,817,235 issued to Lawrence Stephan Blake on Jun. 18, 1974, and U.S. Pat. No. 3,665,910 issued to Orlundo Board on May 30, 1972, also disclose devices for projecting hockey pucks.

While various hockey puck projectors are known, it would be advantageous to provide an apparatus with the capability of projecting pucks at selectable speeds. Additionally, it would be advantageous to provide an apparatus capable of guiding and projecting pucks such that their trajectory and targets are predictable. It would also be advantageous to provide an apparatus capable of projecting a plurality of pucks at a plurality of predefined targets.

SUMMARY OF THE INVENTION

The present invention provides for a hockey puck projector for projecting hockey pucks of the type having a pair of substantially flat and parallel surfaces joined by a side surface. The projector includes means for slidably supporting a puck at one of the flat surfaces, and means for substantially engaging the puck at the other of the flat surfaces and imparting motion to the puck. One embodiment of the projector provides a structural arrangement and computer control arrangement for providing selective projection of the pucks.

The present invention further provides a hockey puck projection system. The system includes a hockey puck projector which is moveable with at least one degree of freedom, a feedback device which produces a first signal representative of the orientation of the projector relative to the frame within the first degree of freedom, and a controller which monitors the first signal and produces first motion signals. The system further includes a first motive device coupled to the controller to move the projector substantially within the first degree of freedom. The first motion signals are applied to the first motive device such that the controller selectively positions the projector.

BRIEF DESCRIPTION OF THE DRAWINGS

FIGS. 3A, 3B, 4A, 4B, 5A and 5B illustrate structural members of the apparatus;

DETAILED DESCRIPTION OF THE PREFERRED EMBODIMENT

Figure 1:
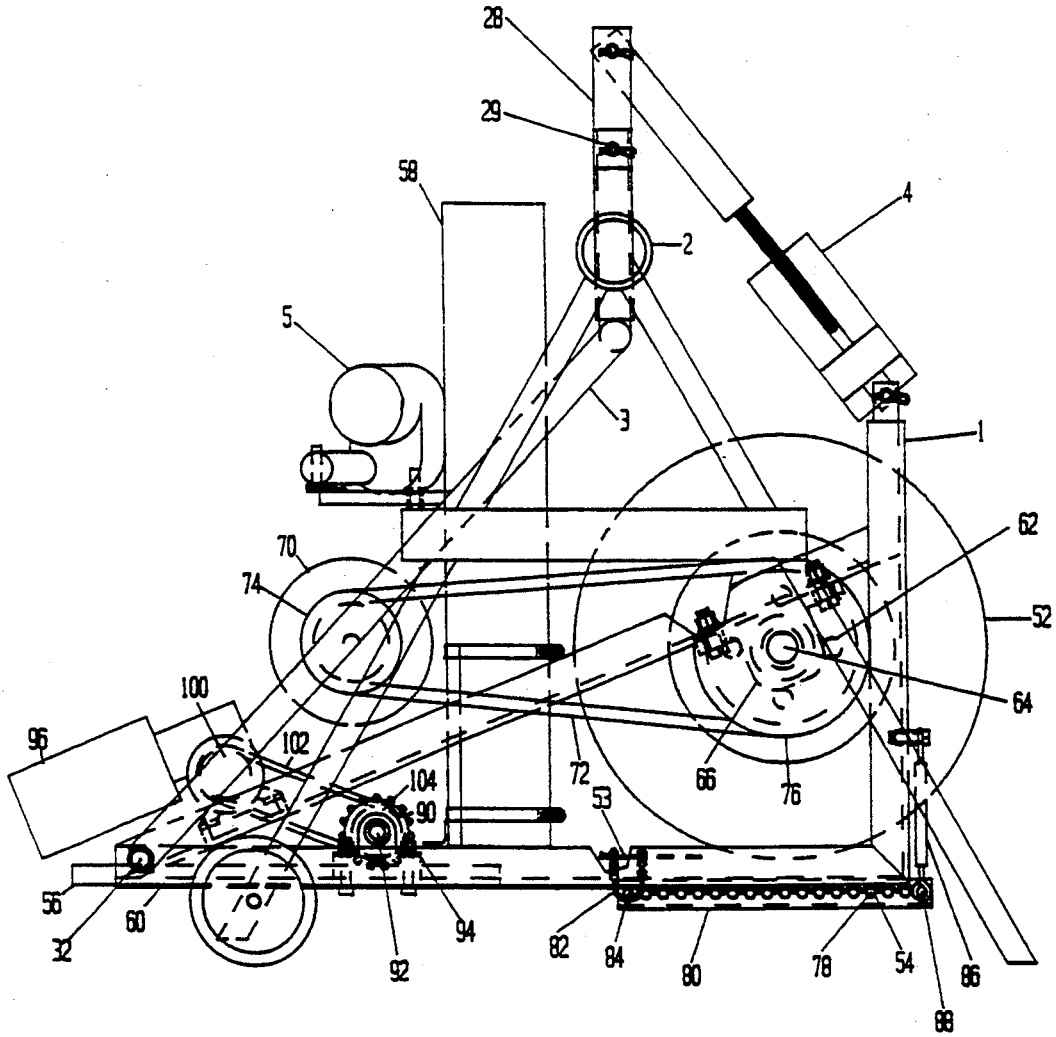
FIG. 1 illustrates a hockey puck projecting and directing apparatus in accordance with a preferred embodiment of the invention.
Figure 2:
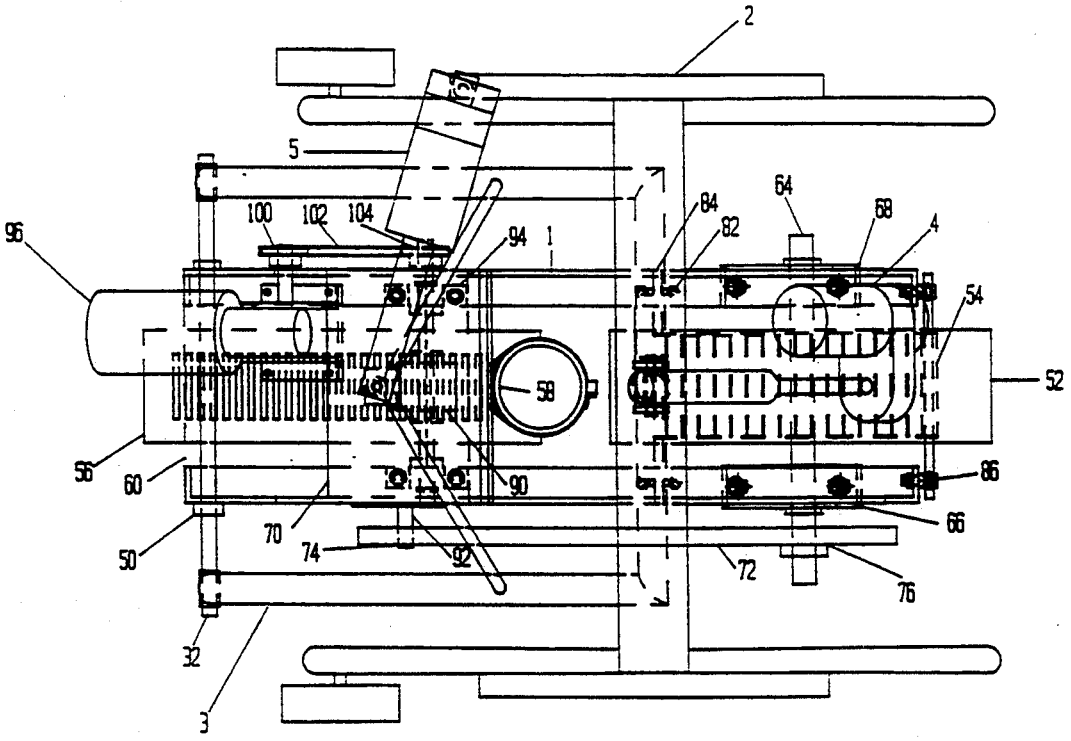
FIG. 2 is a top view of the apparatus.

The main supporting components of the hockey puck projecting and directing apparatus (hockey puck projector) are a support frame assembly 1 and a support frame assembly 2. Frame 1 supports all mechanisms and sub-mechanisms to accelerate the puck. Frame 2 supports frame 1 through a member 3, a vertical control servo 4, and a horizontal control servo 5. Frame 2 stands on the ground (ice) and supports frame 1, allowing frame 1 to be rotated in the horizontal and vertical planes. The rotation of frame 1 in the horizontal and vertical planes gives directional control of puck firing trajectory. Accordingly, frame 1 has two degrees of freedom, one substantially along horizontal planes and one along vertical planes.

Figure 3B:
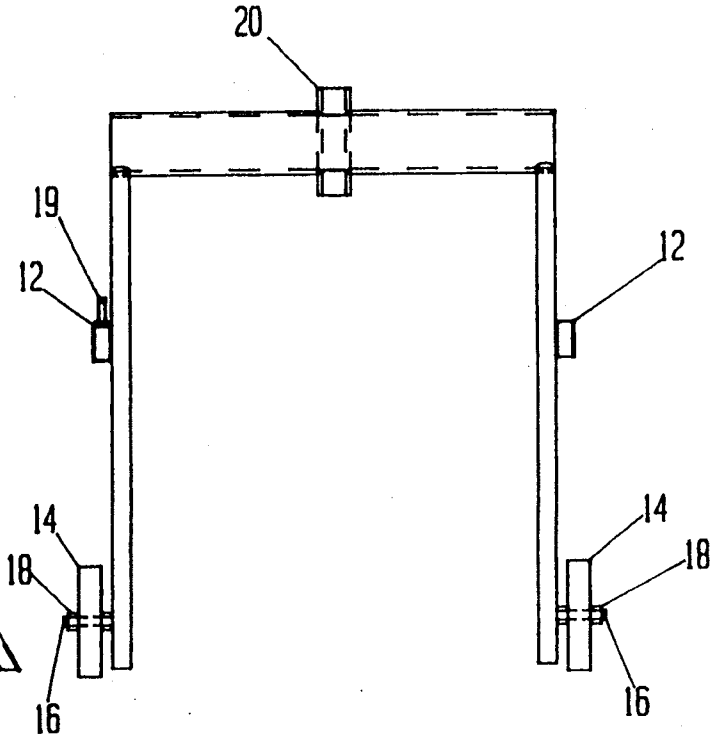
Figure 3A:
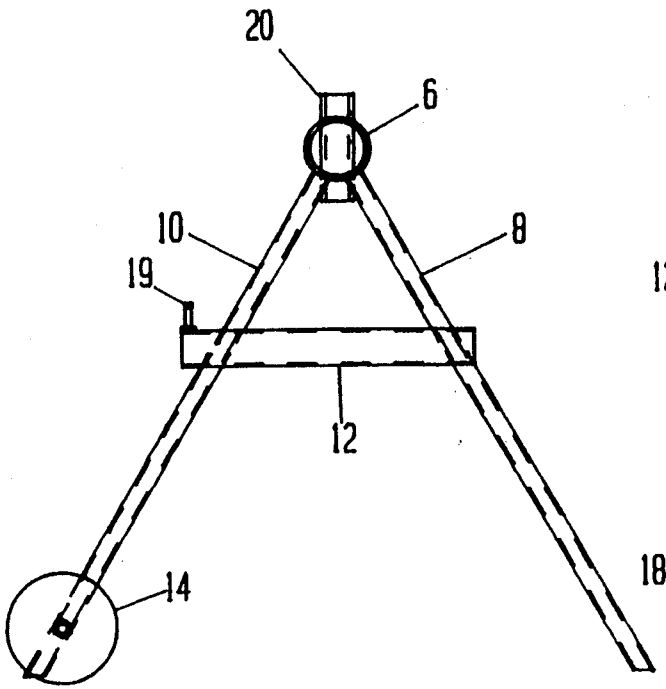

Frame 2 shown in FIGS. 3A and 3B, is a welded assembly. A Tube 6 is supported by two sets of legs, a leg 8 and a leg 10. Connecting leg 8 and leg 10 is a square tube 12. Square tube 12 acts as a support between the legs, it also creates a place for hockey sticks to be slid into. The hockey sticks then act as handles to make the machine easier to move around. With the hockey sticks positioned in square tubes 12 the machine resembles a wheelbarrow. A pair of wheels 14 and the hockey sticks are the wheels and handles of a wheelbarrow respectively. The rest of the machine is the load carried by the wheelbarrow. Wheels 14 are the only items not welded to frame 2 assembly. Wheels 14 bear on standard ½ inch bolts 16. Bolts 16 are welded to legs 10. Wheels 14 are retained on bolts 16 by standard ½ nuts 18. A tube 20 is located in a hole milled through tube 6. Tube 20 acts as a bearing for member 3. A bolt 19 is welded to tube 12 to create a connection point for servo 5. By way of example, the material of frame 2, excluding wheels 14, may be mild steel. Any material with the desired properties may be used for the above applications, such as an appropriate plastic.

Figure 5A:
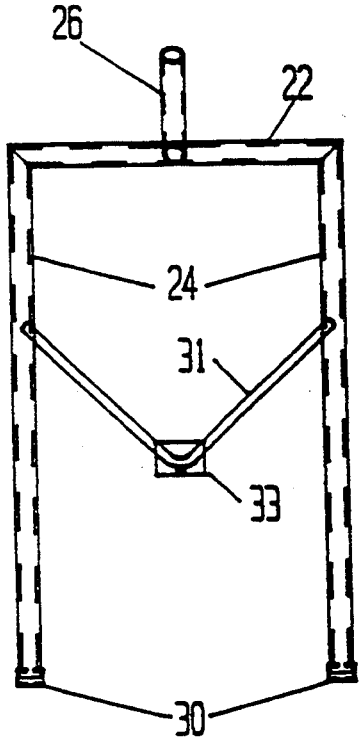
Figure 5B:
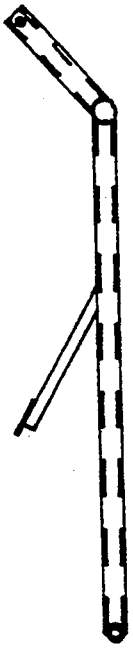
Figure 6:
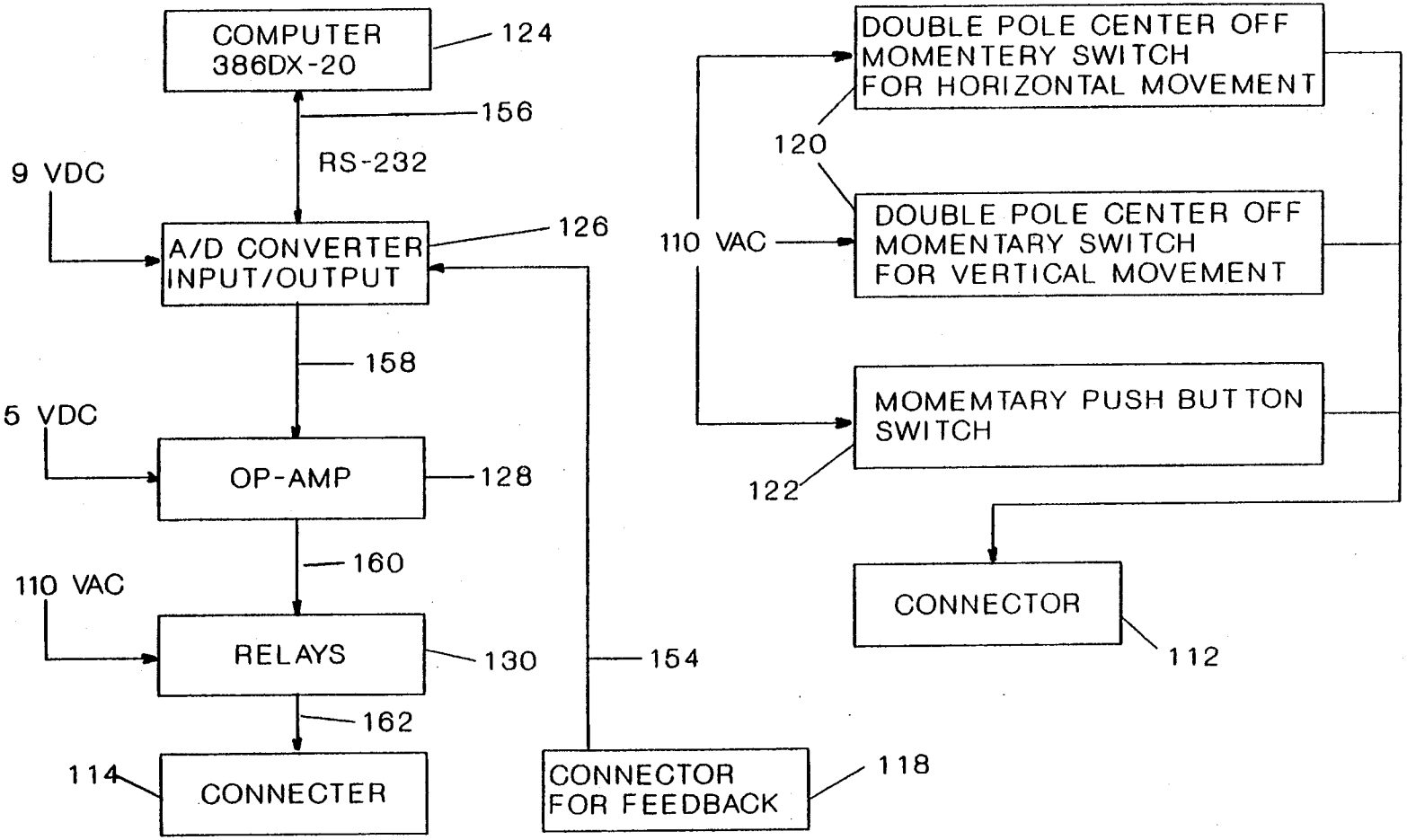
FIG. 6 is a block diagram of a first portion of a preferred embodiment of a control system for operating the apparatus.
Figure 7:
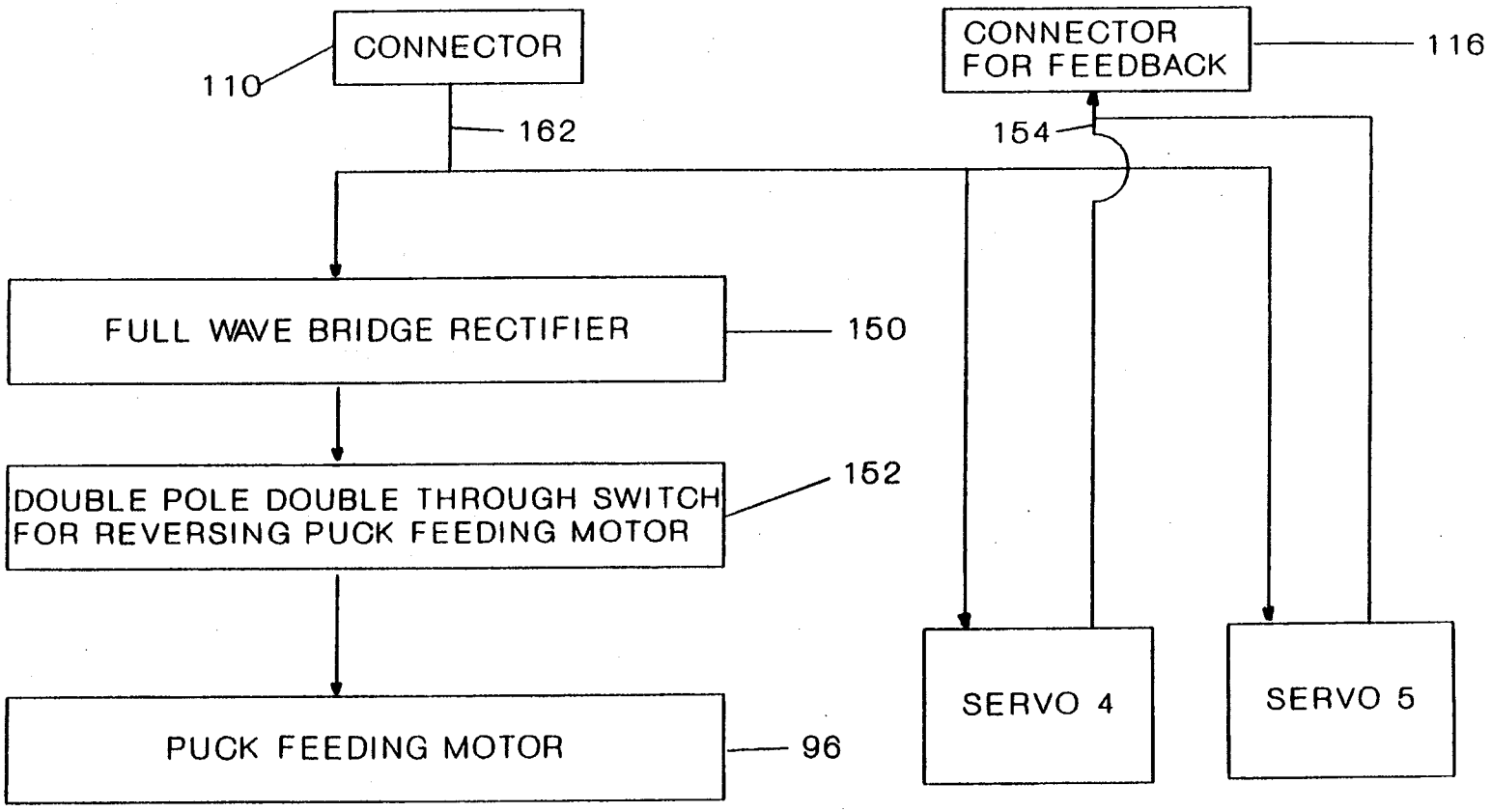
FIG. 7 is a block diagram of a second portion of the preferred embodiment of the control system.

Member 3, shown in FIGS. 5A and 5B, is a welded assembly. Its purpose is to support and allow movement between frame 1 and frame 2. A tube 22 has a tube 24 welded at both ends and a tube 26 welded in the middle. Tube 26 has an outer diameter equal to the inner diameter of tube 20 in the frame 2 assembly. This allows a pivot point between frame 2 and member 3. Once frame 2 and member 3 are coupled together, clevis 28 is pinned to tube 26 by pin 29. Clevis 28 transfers downward force acting on member 3 to tube 20, inturn to frame 2. Clevis 28 allows only rotational movement of member 3 relative to frame 2. The end of tube 24 is a $\frac{5}{8}$ inner diameter tube 30 used as a bushing for a rod 32. Rod 32 passes through tube 30 then through frame 1 and back through tube 30 on the opposite side of member 3. Rod 32 supports the back of frame 1 and allows rotational movement between frame 1 and member 3. A tube 31 with a plate 33 at its center is welded between tubes 24 and acts as a connecting point for servo 5. Servo 5 is attached to plate 33 by a standard $\frac{3}{8}$" diameter bolt and nut to fit. Member 3 may be fabricated from mild steel components. Any material with the desired properties could be used for above described applications.

Frame 1, shown in FIG. 4A and 4B, is a welded assembly, made up of two triangular sections of mild steel angle iron members. The triangular sections include an angle iron piece 34, an angle iron piece 36 and an angle iron piece 38. The two triangular sections are joined by an angle iron piece 40, a flat bar piece 42, a motor mount 44, and a motor mount 46. A piece 48 is welded to piece 40 to support the puck holding tube. A clevis 49 is welded to piece 42 to provide a connection for servo 4. A collar 50 is welded on to give bearing for rod 32.

There are two stages by which the puck is accelerated to a desired speed. The primary stage of firing is done by a wheel 52 and rollers 54. Wheel 52 spins at a rotational velocity that results in a tangential speed at the outer most fiber of wheel 52 equal to the desired speed for the puck to travel. Rollers 54 are located below wheel 52. The puck is fed between wheel 52 and rollers 54 by puck feeding mechanism. When rotating wheel 52 frictionally engages the top flat surface of the puck, the puck is accelerated and imparted motion (projected). Rollers 54 slidably support the bottom flat surface of the puck. More specifically, rollers 54 provide a low resistance path of travel for the puck. A plate 53 keeps the puck flat relative to the rollers when first entering under the wheel. By way of modification, wheel 52 may be replaced by any other arrangement for engaging one of the flat surfaces of the puck and imparting motion to the puck. For example, wheel 52 may be replaced with a belt drive arrangement. By way of further modification, rollers 54 may be replaced with a low friction plate, such as a Teflon® coated plate, to slidably support the puck at one of the flat surfaces of the puck. Additionally, depending upon the application, rollers 54 may be replaced with one roller, a wheel, a powered wheel, a powered set of rollers or wheels, a free moving belt arrangement, or a powered belt.

The secondary stage of firing is also a puck feeding mechanism. A ram 56 accelerates the bottom puck of the stack of pucks contained in holder 58. The pucks are accelerated to a velocity that is adequate to feed the primary firing mechanism. Puck and ram 56 move along slide 60 towards the primary firing mechanism. After the puck is accelerated and fed to wheel 52 and rollers 54, ram 56 reverses movement and moves back to original position to ready for firing.

Wheel 52 may be a standard 16.0 inch trailer tire or a specially design solid rubber wheel which could give better wear and frictional characteristics. Wheel 52 is supported by hub 62. Hub 62 connects wheel 52 to shaft 64. Shaft 64 is supported by bearing 66 and bearing 68. Bearing 66 and bearing 68 are connected to frame 1 by standard $\frac{1}{2}$ bolts with nuts.

Wheel 52 is propelled by a $\frac{3}{4}$ hp 3450 rpm electric motor 70. Motor 70 is bolted to frame 1. Belt 72 couples a driver pulley 74 and a driven pulley 76. Driven pulley 76 drives shaft 64 which drives hub 62 turning wheel 52. The driver pulley 74 is three inches in diameter and spins at 3400 rpm with motor 70. Driven pulley 76 is six inches in diameter, in turn spins at 1700 rpm. A rotational speed of 1700 rpm on the wheel 52 produces a tangential velocity of approximately 80 MPH. With the above described arrangement, the puck may be fired at about 80 MPH. The velocity the puck is fired can be varied by substituting a variable speed motor for motor 70 or substituting variable speed pulleys in place of driver pulley 74 and/or driven pulley 76.

Rollers 54 are a set of free spinning, graphite impregnated, polymeric rollers. Rollers 54 properties are low inertia, low friction, and low wear. Rollers 54 could replaced by any material having these properties. Each roller 54 is supported by a shaft 78. Shaft 78 is a $\frac{3}{8}$" diameter stainless steel rod. Any material of required strength could be used in this application. Shaft 78 is mounted to subframe 80 and this subassembly is mounted to frame 1. Subframe 80 is mounted at the rear to frame 1 by a U-clamp 82 which fastens shaft 84 to frame 1. Subframe 80 can rotate around shaft 84. Shaft 84 also supports roller 54 at this subframe 80 location. Subframe 80 is mounted at the front to frame 1 by a turn-buckle 86 which acts as an adjustable length two force member connecting frame 1 at one end and shaft 88 at the other end. Shaft 88 passes through subframe 80 supporting roller 54 at this subframe 80 location. The purpose of turn-buckle 86 is to allow subframe 20, which supports and encases rollers 54, to be adjusted relative to frame 1 which in turn allows rollers 54 to be adjusted relative to wheel 52. When the turnbuckle is lengthened or shortened and subframe 80 rotates around shaft 84 all the rollers 54, except the one on shaft 84, move further or closer to the wheel respectively.

Ram 56 is made of high density polypropylene. Slide 60 contains ram 56 on the bottom and two sides creating a channel for the ram to slide in. Ram 56 and a gear 90 act as a rack and a pinion respectively. Ram 56 has teeth machined into the top face. Gear 90 drives these teeth. Gear 90 is attached to a shaft 92. Shaft 92 is supported on each end by a bearing 94. Bearing 94 is mounted to frame 1 by a standard $\frac{3}{8}$ inch bolt and nut. A motor 98 is mounted to frame 1 located just behind motor 70. Motor 98 is a $\frac{1}{8}$ hp DC reversible motor that has rotational speed of 60 rpm. Any reversible motor with the required torque could be used in this application. The motor could be faster or slower depending on the desired speed for ram 56. On the output shaft of motor 98 is a driver sprocket 100. A chain 102 connects driver sprocket 100 to driven sprocket 104. Driven sprocket 104 is mounted to shaft 92. Motor 98 ultimately drives ram 56 to move a puck from the puck storing area to the primary firing mechanism.

Generally, there are two types of electronic control for the projecting apparatus, one is direct manual control and the other is computer control. The controls allow the machine to be operated in a manner which allows the machine to aim and fire hockey pucks in a desired pattern and/or time sequence in three dimensions. The two types of control can be interchanged via a common connector. A connector 110 is mated with a connecter 112 making the connection between the manual controls and the machines servos. Connector 110 is mated with a connecter 114 making the connection between the computer controls and the machine. A connector 116 is also connected to a connector 118 for feed back when the computer control is being connected to the machine.

The manual controls include three switches and a housing to contain them. A double pole center off momentary switch 120 is used to control the horizontal and vertical movement. A push button momentary switch 122 is used to run the puck feeding motor. These switches are mounted to a plastic box. The box can be mounted to the machine or can be left free to be hand held by the operator.

The computer control adds programmability to the machine where the control is based upon the monitoring of feedback to produce motion signals for operating the servos such that the puck projector is selectively positioned within one or both degrees of freedom. The control allows the puck to be selectively and sequentially directed at a plurality of targets. The programmability enables the machine to perform an unlimited number and sequence of firing patterns.

The computer control includes a computer 124, an analog-to-digital converter input/output board 126, five operational amplifiers 128, four relays 130, a full wave rectifier 150, a double pole, and a double throw switch 152. Computer 124 is coupled to board 126 by a serial data communications bus 156, which may have an RS-232 configuration. Computer 124 and board 126 communicate such that computer 124 applies digital ON/-OFF signals to board 126, and board 126 applies digital signals representative of the location of the hockey puck projector relative to support frame assembly 2 to computer 124.

Feedback for the computer control includes potentiometers 164, 166 which are mechanically coupled to servos 4 and 5, and electrically coupled to board 126. Potentiometers 164, 166 are supplied with 5 volts from board 126, and each apply a voltage between 0 and 5 volts to board 126, where the voltages are representative of the position of the hockey puck projector relative to support frame assembly 2. Board 126 converts the voltage signals from potentiometers 164, 166 to 8 bit signals which are applied to computer 124 as discussed above.

Board 126 is also coupled to amplifiers 128 by a 5 channel analog data bus 158. Amplifiers 128 each amplify and isolate the digital signal passed though board 126 from computer 124. Each amplifier 128 is coupled to a relay (switch) 130 by five channel data bus 160, and opens or closes the respective relay depending upon the status of the digital signal applied to the associated amplifier 128.

Relays 130 are connected to rectifier 130, servo 4 and servo 5 by data bus 162. Relays 130 allow the selective application of a power source, such as a standard 110 volt source, to rectifier 150, servo 4 and servo 5. Ram 56 is arranged to interact with switch 152 such that when ram 56 reaches the ends of its stroke the switch is switched and the polarity of the current applied from rectifier 150 to motor 96 is changed. Accordingly, ram 56 will oscillate between its stoke ends and provide hockey pucks to wheel 52 until the associated relay 130 is opened.

By way of example only, computer 124 may be any microcomputer, such as, a 386DX-20 manufactured by Pan Overseas Technologies Corporation, board 126 may include an ADC-16 analog to digital converter board and EX-16 input/output board, both supplied by Electronics Energy Control, Inc., amplifiers 128 may be Archer 324 Quad Op Amps powered by batteries, relays 130 may be solid state relays supplied by Mignecraft Corporation, and the servos may be Hubble Corporation model Mc42-1000 servos that operate at 110 volts, 60 hertz and 1.95 amps. Depending upon the application, and the financial resources available, all of the above components, and the use of analog and digital signal may be modified. For example, potentiometers 164, 166 may be replaced with encoders or resolvers thus requiring a change in configuration. It is contemplated that many arrangements may be used so that computer 124 may control the position of hockey puck projector relative to frame assembly 2 based upon feedback or based upon open loop control such as timing.

The computer control operates to allow the user to program computer 124 such that the puck projector may be aimed to selectively project hockey pucks at various locations in reference to a general target such as a goalie or other hockey player. This allows a player to work out alone and practice hitting hockey pucks projected at the player in a wide range of locations at varying or constant intervals of time. Additionally, the speed of wheel 52 may be controlled to project pucks at a selected speed. By way of example only, programming for computer 124 may be done with GWBasic. The current embodiment of the program for performing the above discussed operations is listed in Appendix A.

It will be understood that the above description is of the preferred exemplary embodiment of the invention and that the invention is not limited to the specific form shown. By way of example, the support structure and the electronics may be modified depending upon the application and available technology. Various other substitutions, modifications, changes and omissions may be made in the design and arrangement of the preferred embodiment without departing from the spirit of the invention as expressed in the appended claims.

Appendix A

```
10 CLS
20 PRINT "Are 5 Pucks loaded in the Machine"
30 INPUT Q$
40 IF Q$==Y" THEN 70
50 IF Q$="N" THEN END
60 GOTO 20
70 DIM A$(16)
80 C1=0
```

-continued

Appendix A

```
90 D1=0
100 OPEN "DATA" FOR INPUT AS #2
110 FOR P = 1 TO 5
120 PY$(P) = INPUT$(1,2)
130 PX$(P) = INPUT$(1,2)
140 NEXT P
150 P=1
160 ON KEY (1) GOSUB 930
170 KEY (1) ON
180 ON ERROR GOTO 510
190 OPEN "COM1:19200,N,8,2,DS,CD,CS" AS #1
191 ON ERROR GOTO 510
200 REM
210 FOR X=1 TO 2
220 Z=X
230 PRINT #1, CHR$(Z);
240 IF Y>100 THEN 280
250 IF EOF(1)=-1 THEN Y=Y+1:GOTO 240
260 A$(X) =]INPUT$(1,1)
270 NEXT X
280 Y = 0
290 IF EOF(1) = -1 THEN 310
300 CLOSE #1:GOTO 190
310 LOCATE 1,1
320 FOR X=1 TO 2
330 IF X=1 THEN Z=2
340 IF X=2 THEN Z=1
350 PRINT ASC(A$(X)),"CHANNEL", Z
360 NEXT X
370 ON KEY (1) GOSUB 930
380 KEY (1) ON
390 IF ASC(A$(2)) > ASC(PY$(P)) THEN IF C1<1 THEN C1=5 :GOSUB 670
400 IF ASC(A$(2)) < ASC(PY$(P)) THEN IF C1<1 THEN C1=6 :GOSUB 520
410 IF ASC(A$(2)) > ASC(PY$(P)) THEN IF C1=6 THEN C1=10:GOSUB 720
420 IF ASC(A$(2)) < ASC(PY$(P)) THEN IF C1=5 THEN C1=10:GOSUB 720
430 IF ASC(A$(1)) > ASC(PX$(P)) THEN IF D1<1 THEN D1=5 :GOSUB 570
440 IF ASC(A$(1)) < ASC(PX$(P)) THEN IF D1<1 THEN D1=6 :GOSUB 620
450 IF ASC(A$(1)) > ASC(PX$(P)) THEN IF D1=6 THEN D1=10:GOSUB 770
460 IF ASC(A$(1)) < ASC(PX$(P)) THEN IF D1=5 THEN D1=10:GOSUB 770
470 IF ASC(A$(2) = ASC(PY$(P)) THEN C1= 10 :GOSUB 720
480 IF ASC(A$(1)) = ASC(PX$(P)) THEN D1= 10 :GOSUB 770
490 IF C1=10 THEN IF D1 = 10 THEN GOSUB 820
500 GOTO 210
510 RESUME
520 LOCATE 7,1
530 PRINT "TURN ON I/O 1, TURN OFF I/O 2        "
540 PRINT #1, CHR$(34) 'TURN OFF #2
550 PRINT #1, CHR$(33) 'TURN ON #1
560 RETURN
570 LOCATE 6,1
580 PRINT "TURN ON I/O 4, TURN OFF I/O 3        "
590 PRINT #1, CHR$(36) 'TURN OFF #3
600 PRINT #1, CHR$(39) 'TURN ON #4
610 RETURN
620 LOCATE 6,1
630 PRINT "TURN ON I/O 3, TURN OFF I/O 4        "
640 PRINT #1, CHR$(38)
650 PRINT #1, CHR$(37)
660 RETURN
670 LOCATE 7,1
680 PRINT "TURN ON I/O 2, TURN OFF I/O 1        "
690 PRINT #1, CHR$(32) 'TURN OFF,#1
700 PRINT #1, CHR$(35)
710 RETURN
720 LOCATE 7,1
730 PRINT "TURN OFF I/OS 1,2          "
740 PRINT #1, CHR$(32)
750 PRINT #1, CHR$(34)
760 RETURN
770 LOCATE 6,1
780 PRINT "TURN OFF I/OS 3,4          "
790 PRINT #1, CHR$(36)
800 PRINT #1, CHR$(38)
810 RETURN
820 REM     FIRING SUBROUTINE
821 LOCATE 9,1
822 PRINT "FIRING AT THE GOAL "
823 PRINT #1, CHR$(41)
824 FOR X= 1 TO 17000
825 NEXT X
826 PRINT #1, CHR$(40)
```

-continued

Appendix A

```
827 CLS
830 IF P=5 THEN END
840 P = P+1
850 C1=0
860 D1=0
870 IF PY$(P) = PY$(P-1) THEN C1=10
880 IF PX$(P) = PX$(P-1) THEN D1=10
890 LOCATE 3,1
900 PRINT "MOVING TO LOCATION ON CHANNEL 2, #",ASC(PX$(P))
910 PRINT "MOVING TO LOCATION ON CHANNEL 1, #",ASC(PY$(P))
920 RETURN
930 CLS
940 PRINT #1, CHR$(32)
950 PRINT #1, CHR$(34)
960 PRINT #1, CHR$(36)
970 PRINT #1, CHR$(38)
980 PRINT #1, CHR$(40)
990 PRINT          Program Terminated"
1000 PRINT         All Channels Shut off"
1010 END
```

We claim:

1. A hockey puck projection system comprising:

a hockey puck projector;

a frame coupled to the projector such that the projector has at least a first degree of freedom;

a feedback device disposed to produce a first signal representative of the location of the projector relative to the frame within the first degree of freedom;

a controller coupled to the feedback device to monitor the first signal and produce first motion signals; and a first motive device coupled to the controller to move the projector relative to the frame substantially within the first degree of freedom, where the first motion signals are applied to the first motive device such that the controller selectively positions the projector relative to the frame within the first degree of freedom.

2. The projector of claim 1, where the projector has at a second degree of freedom, and the projector further comprises a second feedback device disposed to produce a second signal representative of the location of the projector relative to the frame within the second degree of freedom; and a second motive device coupled to the controller to move the projector relative to the frame substantially within the second degree of freedom, the controller being coupled to the second feedback device to monitor the second signal and produced a second motion signal, and the second motion signals being applied to the first motive device such that the controller selectively positions the projector relative to the frame within the second degree of freedom.

3. A hockey puck projection system comprising:

projection means for projecting a hockey puck;

support means for supporting the projection means with at least a first degree of freedom;

feed back means for producing a signal representative of the location of the projection means relative to the support means within the first degree of freedom;

control means, coupled to the feedback means, for monitoring the first signal and producing first motion signals; and motive means, coupled to the control means, for moving the projection means relative to the support means substantially within the first degree of freedom, where the first motion signals are applied to the motive means such that the control means selectively positions the projection means relative to the support means within the first degree of freedom.

4. The projector of claim 3, where the feedback means is a potentiometer.

5. The projector of claim 4, where the control means is a computer and the motive means is a servo.

* * * * *